US009095767B2

(12) United States Patent
Kuntz

(10) Patent No.: US 9,095,767 B2
(45) Date of Patent: Aug. 4, 2015

(54) RINK DIVIDER RAISING AND LOWERING SYSTEM

(71) Applicant: Icon HD, LLC, Grand Forks, ND (US)

(72) Inventor: Michael R. Kuntz, Grand Forks, ND (US)

(73) Assignee: Icon HD, LLC, Grand Forks, ND (US)

( * ) Notice: Subject to any disclaimer, the term of this patent is extended or adjusted under 35 U.S.C. 154(b) by 0 days.

(21) Appl. No.: 14/148,098

(22) Filed: Jan. 6, 2014

(65) Prior Publication Data

US 2014/0190100 A1 Jul. 10, 2014

Related U.S. Application Data

(60) Provisional application No. 61/749,022, filed on Jan. 4, 2013.

(51) Int. Cl.

| | |
|---|---|
| ***A63C 19/10*** | (2006.01) |
| ***A63C 19/08*** | (2006.01) |
| ***E04B 2/88*** | (2006.01) |

(52) U.S. Cl.

CPC . *A63C 19/08* (2013.01); *E04B 2/88* (2013.01); *A63C 19/10* (2013.01); *A63C 2019/085* (2013.01)

(58) Field of Classification Search

CPC ..... A63J 1/028; A63C 19/10; A63C 19/06; A63C 2019/085; A47H 7/02

USPC ..... 52/6, 24.1, 243.1, 238.1; 160/330–332; 472/75–80, 92; 62/235

See application file for complete search history.

(56) References Cited

U.S. PATENT DOCUMENTS

| | | | | |
|---|---|---|---|---|
| 3,165,296 | A * | 1/1965 | Drew | 472/78 |
| 4,062,519 | A * | 12/1977 | Jacobs | 160/331 |
| 4,497,483 | A * | 2/1985 | Ahlgren | 472/90 |
| 5,897,438 | A * | 4/1999 | Kunz et al. | 472/90 |
| 7,204,764 | B2 * | 4/2007 | Gottfried | 472/92 |

OTHER PUBLICATIONS www.tmi-pvc.com/industrial-curtains.html.*

* cited by examiner

*Primary Examiner* — Jeanette E Chapman
*Assistant Examiner* — Daniel Kenny
(74) *Attorney, Agent, or Firm* — Peter J. Ims; Westman, Champlin & Koehler, P.A.

(57) ABSTRACT

A rink divider raising and lowering system is configured to raise and lower a rink divider utilizing a plurality supports secured to existing trusses that supports a roof of an ice rink. The rink divider system includes a plurality of cables have a first end attached to the rink divider and a second end that engages a hoisting mechanism. Each of the plurality of supports has a pulley attached thereto wherein one of the plurality of cables engages the one of the pulleys such that the rink divider can be moved in a substantially vertical plane from a raised position to a lowered position utilizing the hoisting mechanism.

16 Claims, 8 Drawing Sheets

RINK DIVIDER RAISING AND LOWERING SYSTEM

CROSS REFERENCE TO RELATED APPLICATION(S)

This Application claims the benefit of U.S. Provisional Patent Application Ser. No. 61/749,022 filed on Jan. 4, 2013, the contents of which are incorporated by reference in its entirety.

BACKGROUND

The discussion below is merely provided for general background information and is not intended to be used as an aid in determining the scope of the claimed subject matter.

The present disclosure relates to a rink divider system. More particularly the present disclosure relates to a rink divider system that is configured to raise and lower a rink divider from a first, raised position where the rink divider is elevated from an ice surface to a second, lowered position where the rink divider is positioned onto the ice surface to form at least two smaller rinks.

There is a limited amount of indoor ice surfaces or rinks available for people to skate. In particular, obtaining ice time to play hockey is at a premium, especially in cold weather areas.

In many cold weather areas, youth hockey programs consume a significant amount of the available ice time on the indoor rinks. The demand for ice time causes some practices to be inconveniently scheduled for early in the morning or late at night.

However, younger children do not require a full sized rink in order to practice and hone their hockey skills or to play the game of hockey. Rather, when younger player practice on full surface rinks, the amount of ice surface and length of the rink can cause the younger players to become extremely tired which can hinder their development.

Therefore, in hockey divisions or leagues for younger players, it is typical to utilize a divider that is positioned along the centerline (or red line) of the hockey rink. The divider allows the large rink to be divided into two separate rinks, typically of equal dimensions. Being able to divide a single sheet of ice into two separate rinks, allows two youth teams to practice during the same time or two games to be played at the same time, thereby increasing the efficiency of the rink and creating more ice time for other activities.

Typical rink dividers that are currently utilized take a significant amount of time to install and remove. A typical rink divider has many sections that have to be moved into position with manual force and secured together. Installing and uninstalling the rink dividers can take some time, which decreases the availability of the rink for use.

When the ice sheet requires resurfacing, the rink divider must be disassembled and removed from the ice sheet. Once the ice sheet is resurfaced, the rink divider is moved into the selected position and reassembled. As such, there are inefficiencies in utilizing a manually installed rink divider which decreases the amount of ice time for practices and/or games that can be played on the divided rink.

The manually installed rink dividers do not typically have the structural integrity that is comparable to the strength of permanently installed boards of a hockey rink, at least due in part to their non-permanent, component-based installation. Therefore, if a person engages or crashes into the divider, at times the divider or a section of the dividers can be moved, which affects the play in the adjacent rinks.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the present disclosure includes a rink divider raising and lowering system configured to raise and lower a rink divider utilizing a plurality supports secured to existing trusses that supports a roof of an ice rink. The rink divider system includes a plurality of cables have a first end attached to the rink divider and a second end that engages a hoisting mechanism. Each of the plurality of supports has a pulley attached thereto wherein one of the plurality of cables engages the one of the pulleys such that the rink divider can be moved in a substantially vertical plane from a raised position to a lowered position utilizing the hoisting mechanism.

Another aspect of the present disclosure includes a unitary rink divider that has a trussed wall construction with opposing rigid side walls attached to the trussed wall. The trussed wall and the rigid side walls are all typically constructed of a light weight and strong polymeric material, such as high density polyethylene, such that the rink divider is relatively light while providing sufficient strength to be comparable to that of a typical board on a hockey rink. The rink divider also can optionally include arcuate corner panels where the curvature of the arced corner panel can be adjusted either manually or with automatic mechanisms to allow the curvature of the corner panels of the rink divider to be adjusted to be comparable to the curvature of the corner of a particular rink.

Another aspect of the present disclosure includes a controller that communicates with a hoisting device of the rink divider raising and lowering system. The controller allows the hoisting device to be actuated in a manual mode by an operator when the operator desires for the divider to be raised or lowered. The controller can also be automatically controlled, for instance on a timer, such that the hoisting device can be actuated at a selected time or times to raise and lower the dividing wall. The automatic control can be utilized to increase the efficiency of the ice rink to allow the ice to be resurfaced at a selected time by causing the divider wall to be raised. Once the ice sheet has been resurfaced, the controller can be programmed to lower the divider wall at a selected time.

DETAILED DESCRIPTION

Figure 1:
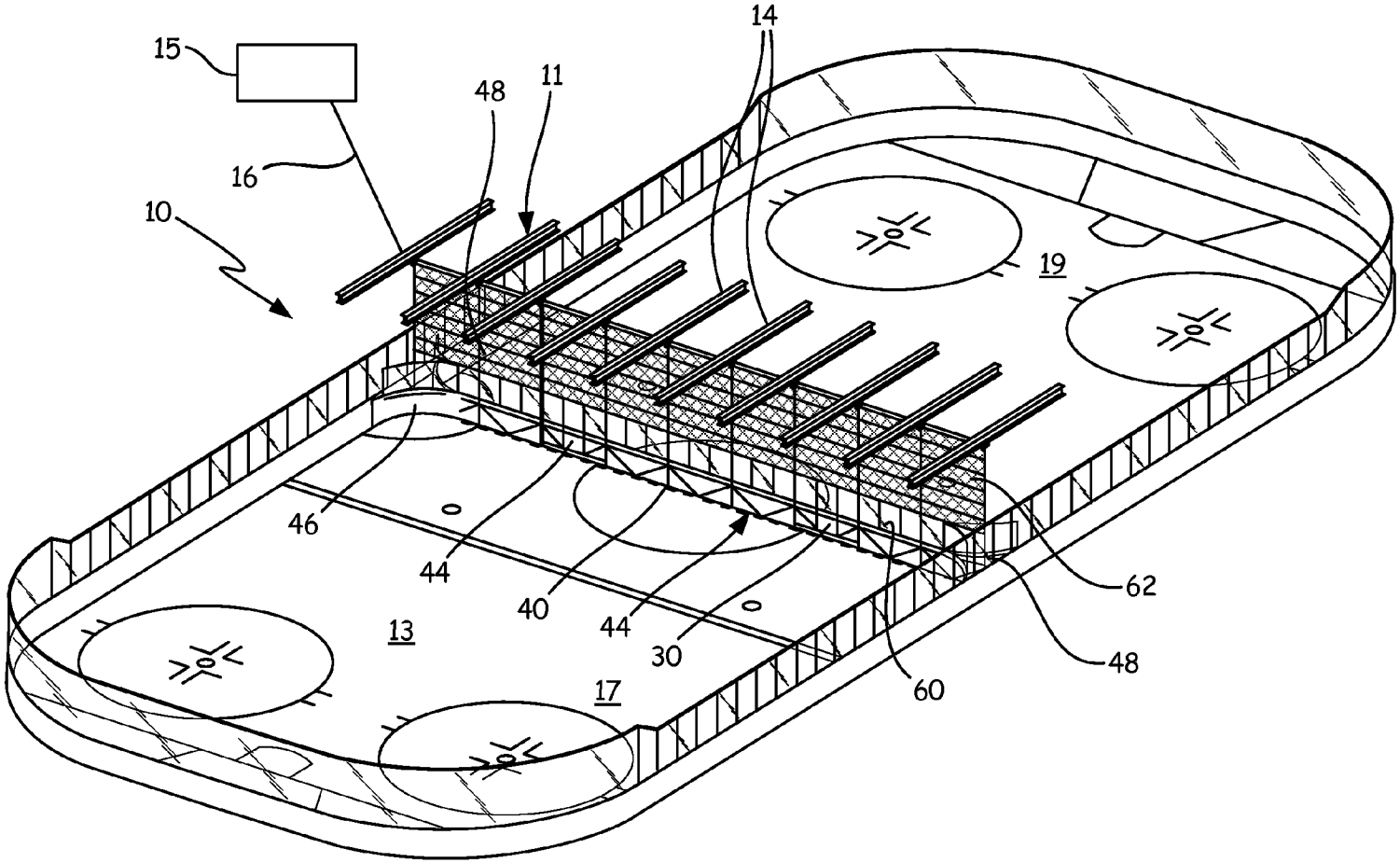
FIG. 1 is a plan view of a rink divider raising and lowering system for an ice rink where a divider wall is positioned on the center line of the rink.

The present disclosure includes a system for raising and lowering hockey rink divider wall that is generally illustrated in FIG. 1 at 10. The system 10 includes a hoisting mechanism 15 that is manipulated to raise and lower a divider wall 12 in a substantially vertical plane such that the divider wall can be raised to a first position that is proximate a roof of the ice rink to a second position where the divider wall is positioned on an ice surface 13.

The system 10 includes a roof support system 11 that is secured to the existing roof structure of an ice rink as generally illustrated at 10 in FIG. 1. The roof support system 11 includes a plurality of beams 14 that are typically secured to at least two trusses of a roof structure such that the plurality of beams 14 are substantially parallel to each other and perpendicular to the trusses of the roof.

Figure 2:
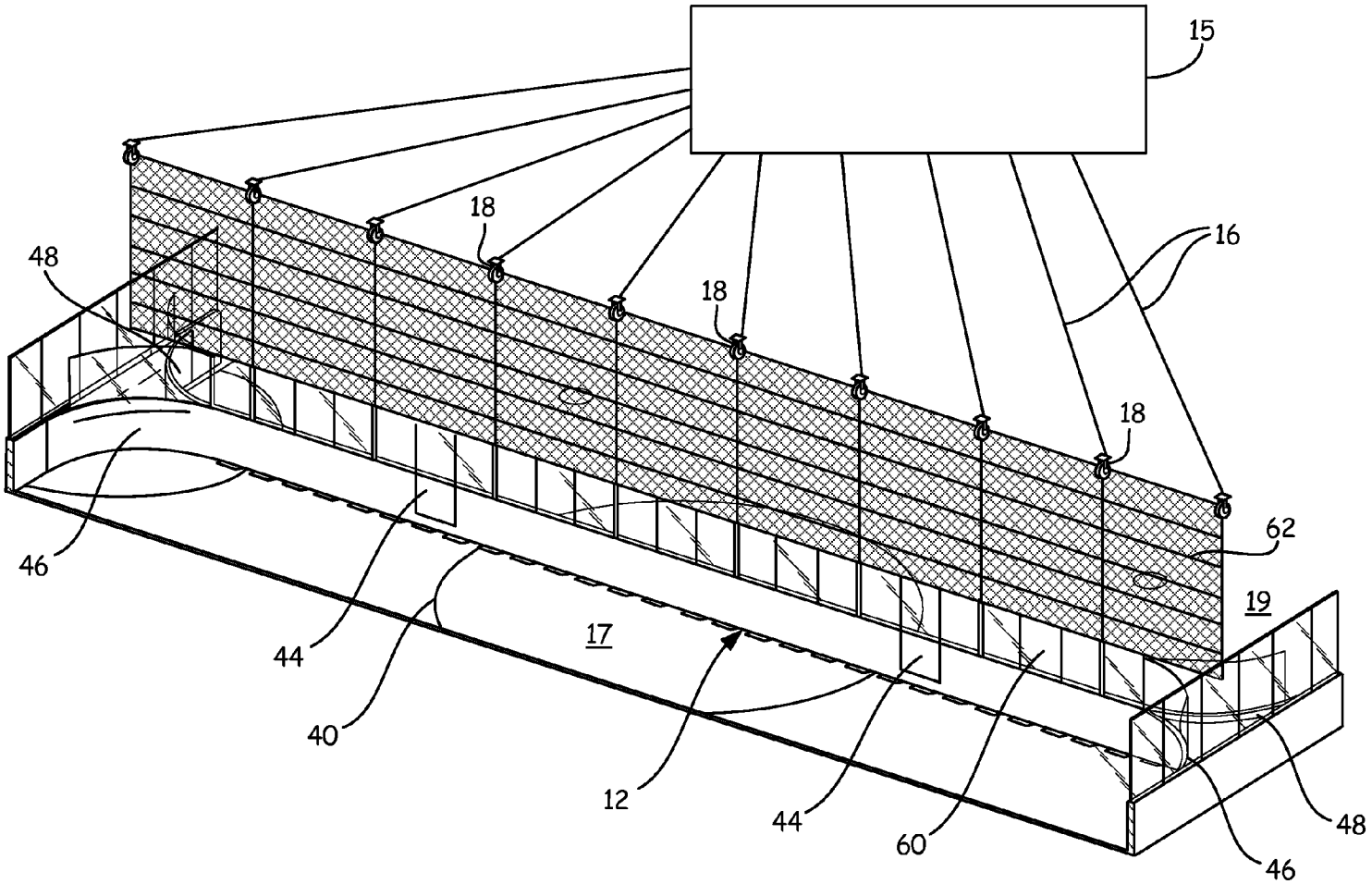
FIG. 2 is a partial perspective view of the divider wall installed upon the ice surface.
Figure 3:
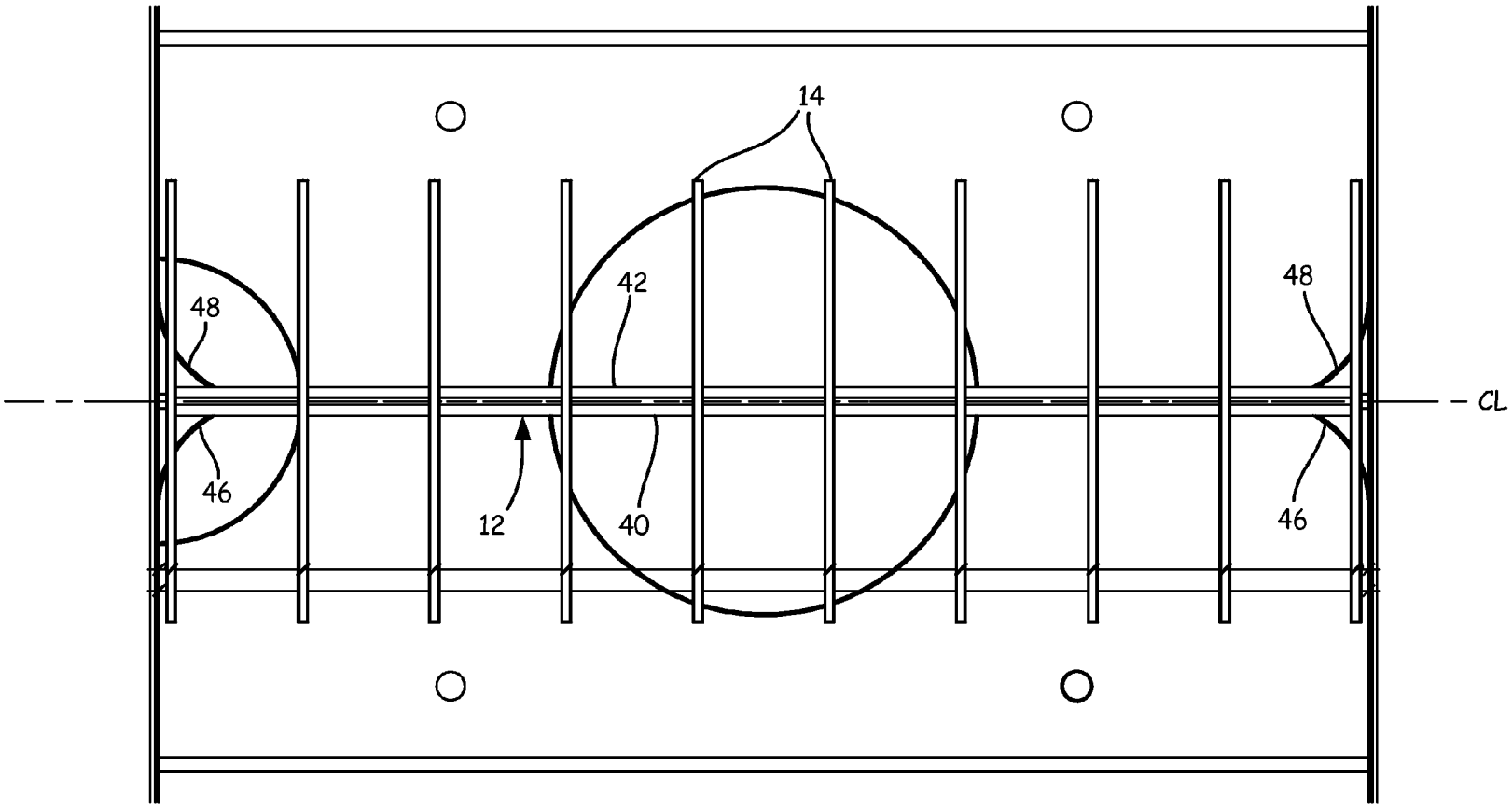
FIG. 3 is a top view of the divider wall installed on the ice surface.
Figure 4:
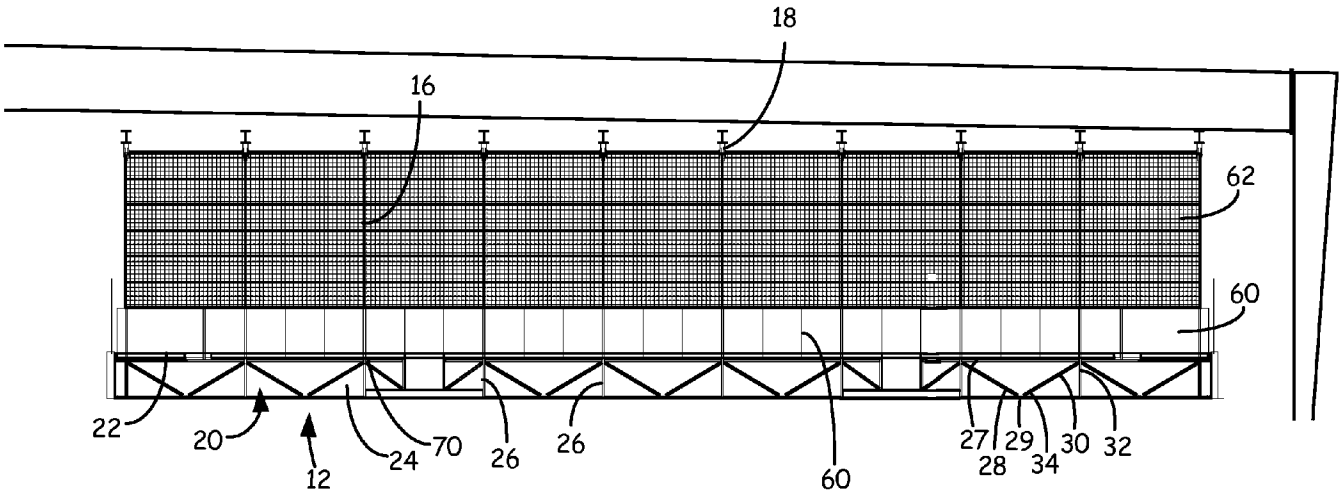
FIG. 4 is a side view of the divider installed on the ice surface.
Figure 5:
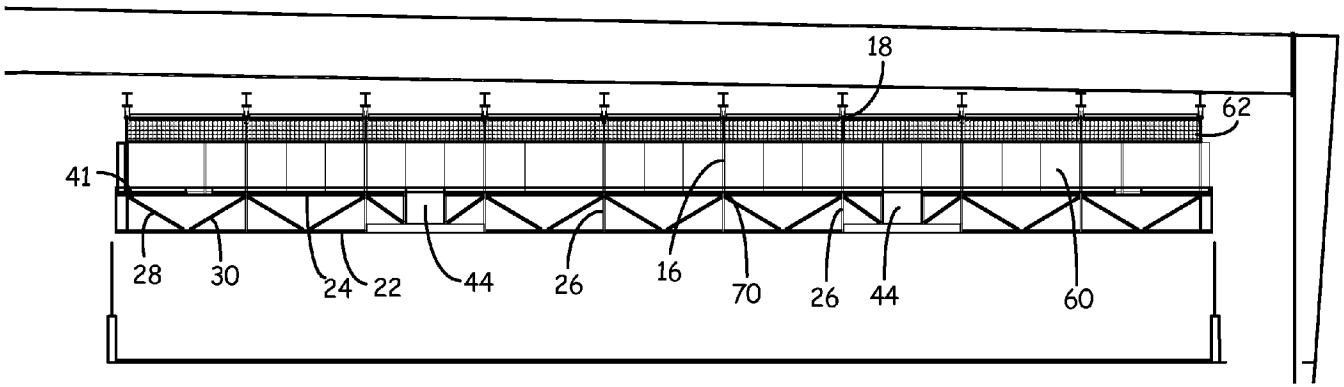
FIG. 5 is a side view of the divider wall raised from the ice surface.

Referring to FIGS. 1-3, the divider wall 12 is coupled to the hoisting mechanism 15 with a plurality of cables 16 that engage a pulley 18 located on each of the plurality of beams 13. The divider wall 12 can then be raised to the first position and lowered to the second position as a single unit, thereby substantially reducing the amount of time required to remove and reinstall the divider wall 12 relative to modular divider walls that are manually removed and reinstalled.

As best illustrated in FIGS. 4-7 the divider wall 12 is constructed with an interior wall frame 20. The interior wall frame includes an upper, substantially horizontal member 22, a lower, substantially horizontal member 24 and a plurality of spaced apart substantially vertical members 26 that attach the upper member 14 and the lower member 16.

The divider wall 12 includes a left truss 28 and a right truss 30 within the space defined by two adjacent vertical members 26, the upper member 22 and the lower member 24. A top end 27 of the left truss 28 is attached proximate an upper junction of one vertical member 26 and the upper member 22. The left truss 28 angles downward to proximate a midpoint on the lower member 24 wherein a bottom end 29 is attached to the lower member 24. A top end 32 of the right truss 30 is attached proximate an upper junction of the other vertical member 26 and the upper member 22. The right truss angles 30 downward to proximate a midpoint on the lower member 24 wherein a bottom end 34 of the right truss 30 is proximate the mid point of the lower member 24 and is also proximate the bottom end 29 of the left truss 28.

The configuration of the left and right trusses 28 and 30 provide for both lateral support and vertical support to the divider wall 20 without significantly increasing the weight of the divider wall 12. While symmetric left and right trusses 28 and 30 are illustrated, other configurations of trusses are also contemplated that provide the necessary lateral and vertical support.

The members of interior wall frame 20 are typically constructed of a lightweight material, such as high density polyethylene. However, the interior wall frame can also be constructed of other materials such as, but not limited, wood and metal, where the metal is typically extruded to reduce the weight of the interior frame wall 20.

Referring back to FIGS. 1-3, 8 and 9 left and right side wall panels 40 and 42 cover the interior wall frame 20, to provide a smooth outer surface while providing additionally strength to the wall 10. A typical outer surface includes a high density polyethylene panel that is typically about 3/16 of an inch thick. However other panels having different thicknesses and/or materials of construction material are also contemplated.

The divider wall 12 can also optionally include one or more doors 44 that are hingedly attached that players, coaches or referees can easily move from one side 15 of the rink to the other side 17 of the rink. The doors 44 typically have a latch or lock to prevent the accidental opening of the doors.

Referring to FIGS. 1-3 and 10 the system 10 also includes corner panels 46 and 48 are removably attached to ends of the divider wall 12 typically with mounting brackets 50, 52 and pins. The corner panels 46 and 48 are typically mirror images of each other and are removable such that when the divider wall 12 is lifted, the corner panels 46 and 48 remain on the ice surface to prevent the wall 12 from swaying while being lifted while also lessening the amount of weight to be lifted by the hoisting mechanism 15. However it is contemplated that corner panels can also be fixedly attached to the ends of the divider wall.

Figure 10:
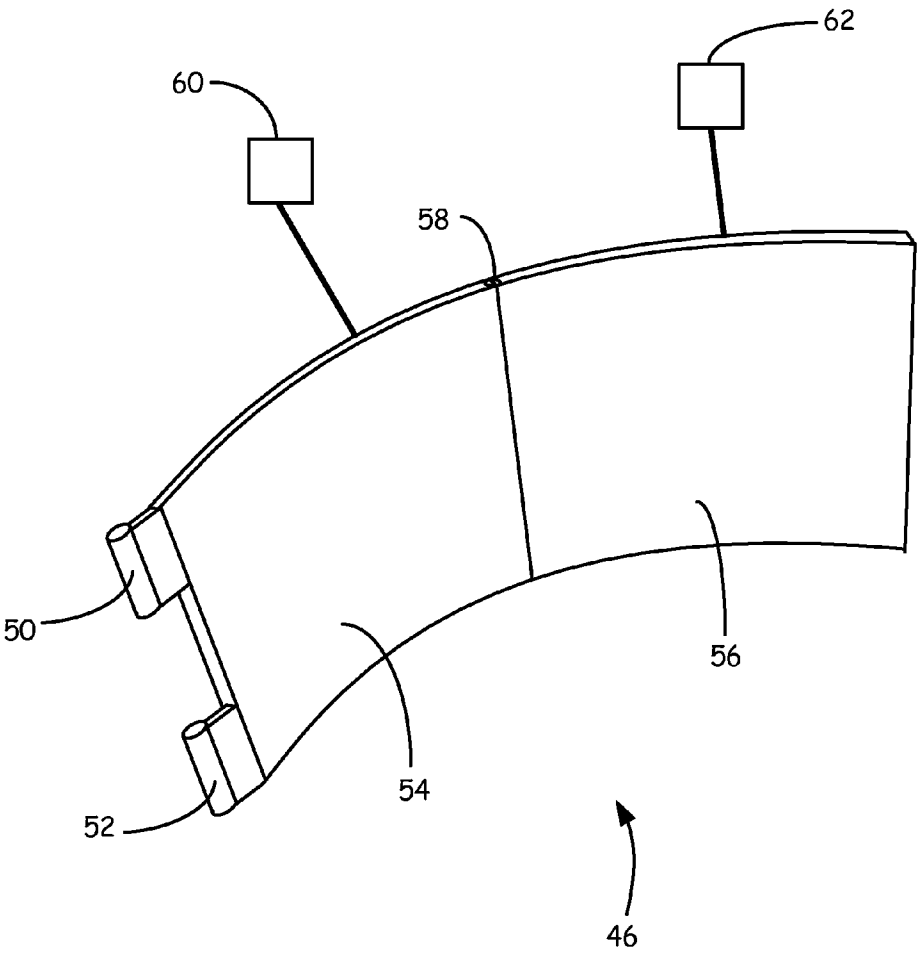
FIG. 10 is a perspective view of a corner panel of the rink divider system.

It is contemplated that the corner panels 46 and 48 be of a fixed construction where the curvature of the corner panels 46 and 48 is fixed. It is also contemplated the corner panels 46 and 48 be constructed of two or more segments 54, 56 that are pivotally attached with a pivot pin 58 at adjacent ends such that the curvature of the corner panels 46 and 48 can be adjusted to provide a similar radius as the corners of the rink. The positioning of the segments 54 and 56 of the corner panels 46 and 48 the corner panels 46, 48 can be adjusted either manually or with a actuator 60 and 62 as illustrated in FIG. 10. The actuator 60 and 62 can be hydraulically, pneumatically or electronically driven. Because the corner panels 46 and 48 can be adjusted to conform to the radius of the existing corner boards, the divider wall 12 provides a more symmetric configuration of the rink and a better playing surface is provided.

Figure 9:
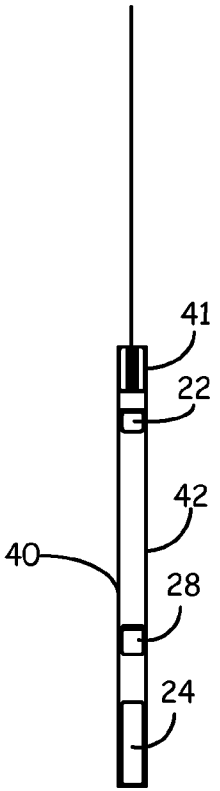
FIG. 9 is a sectional view along section line 9-9 in FIG. 4.
Figure 8:
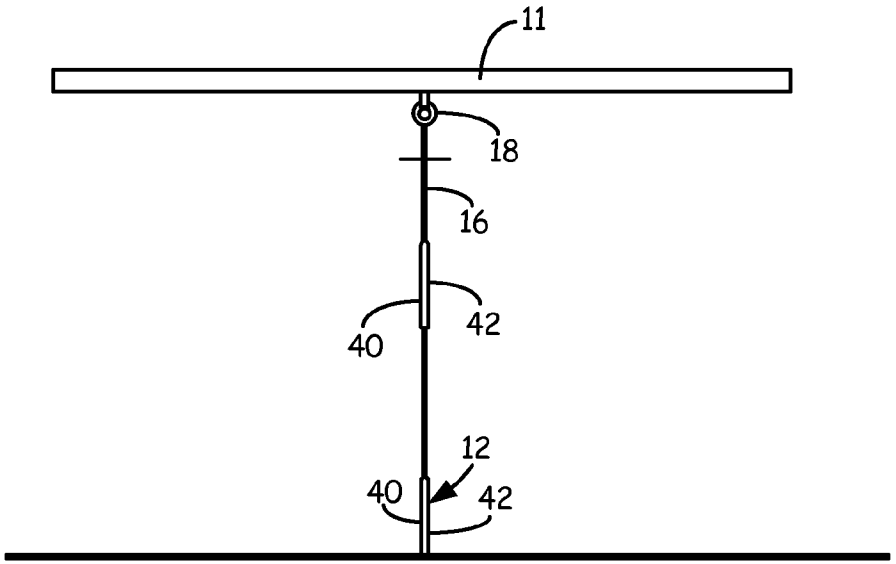
FIG. 8 is a sectional view along section line 8-8 in FIG. 4.

Referring to FIG. 9 the wall 10 can also include a rail cap 41 that is also typically made of high density polyethylene. The wall 10 can also include base boards similar to the base boards around a bottom edge of the boards for the rink, which is also typically constructed of high density polyethylene. However, other materials of construction of the rail cap and base boards are also contemplated.

Referring to FIGS. 1, 2, 4 and 5, optionally the system can include a plurality of see through panels 60 constructed from a shatter resistant material that extend from the top surface of the rail cap 41. One contemplated shatter resistant material is sold under the PLEXIGLAS® trademark. The panels 60 of shatter resistant material provide protection to the people who are in the other rink 15 or 17. To further protect the players, coaches and referees on one half rink 15 from the other half rink 17, it is also contemplated that optional safety netting 62 can be included with the wall 10 design.

Figure 6:
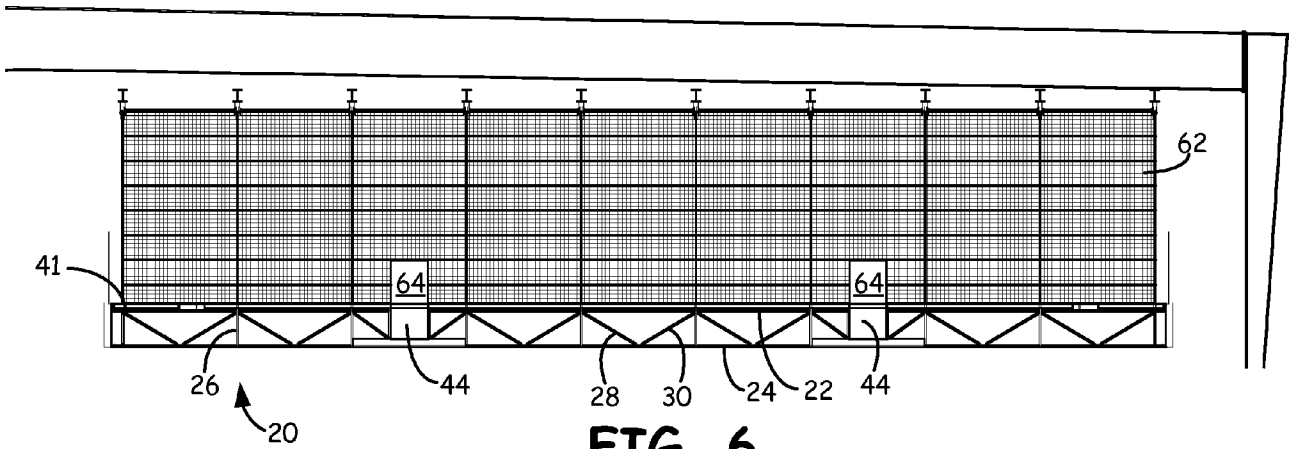
FIG. 6 is a side view of an alternative construction of the divider wall installed on the ice surface.
Figure 7:
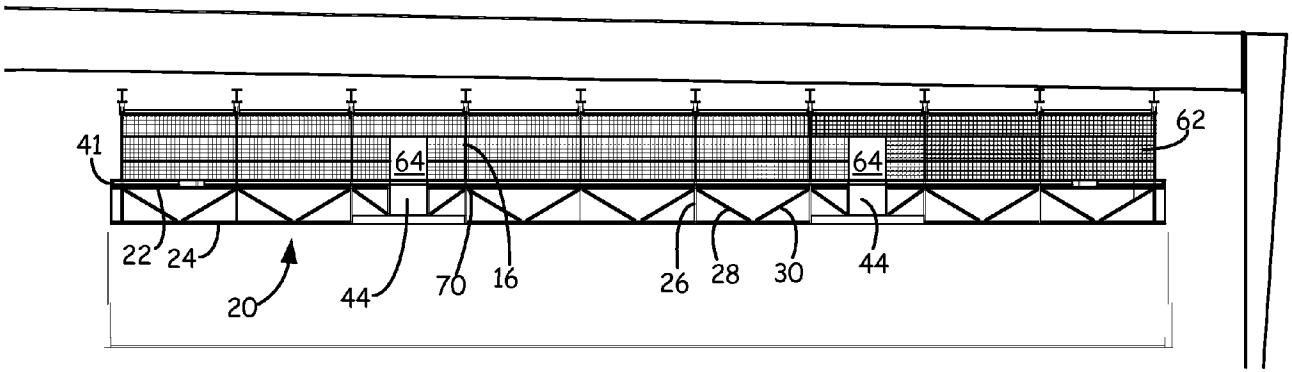
FIG. 7 is a side view of the alternative construction of the divider wall raised from the ice surface.

In an alternative configuration, the safety netting extends from the rail cap to the support beams as illustrated in FIGS. 6 and 7. In the alternative configuration, the panels are replaced with netting 62 which can reduce the weight of the divider wall 12 to be hoisted as well as the cost of the system. The alternative configuration includes cutouts 64 above the doors 30 to allow people to easily pass from one side of the divider wall to the other side without having crouch.

The divider wall 10 is raised and lowered utilizing the plurality of cables 16. Each cable has a first end 70 attached to the divider wall 12 and a second end attached to the hoisting system 15. The cables 16 are woven through apertures in the safety netting 62 and engage the pulleys 18 that are attached to support beams 11. The apertures in the netting 62 typically have grommets secured around the edges to prevent the netting 62 from tearing while being raised and lowered.

As the divider wall 12 is raised, the netting 62 folds about the cable 16 and the netting 16 does not interfere with the pulleys 18. Exemplary hoisting systems include a rotating drum, pulley geared system or other type of hoisting system is capable of raising the wall system including the portion 12, the panels 60 and the netting 62 to an elevated location such that the wall system 10 is stored within the underside of the roof structure and moved out of the way when the entire ice surface is required.

Figure 11:
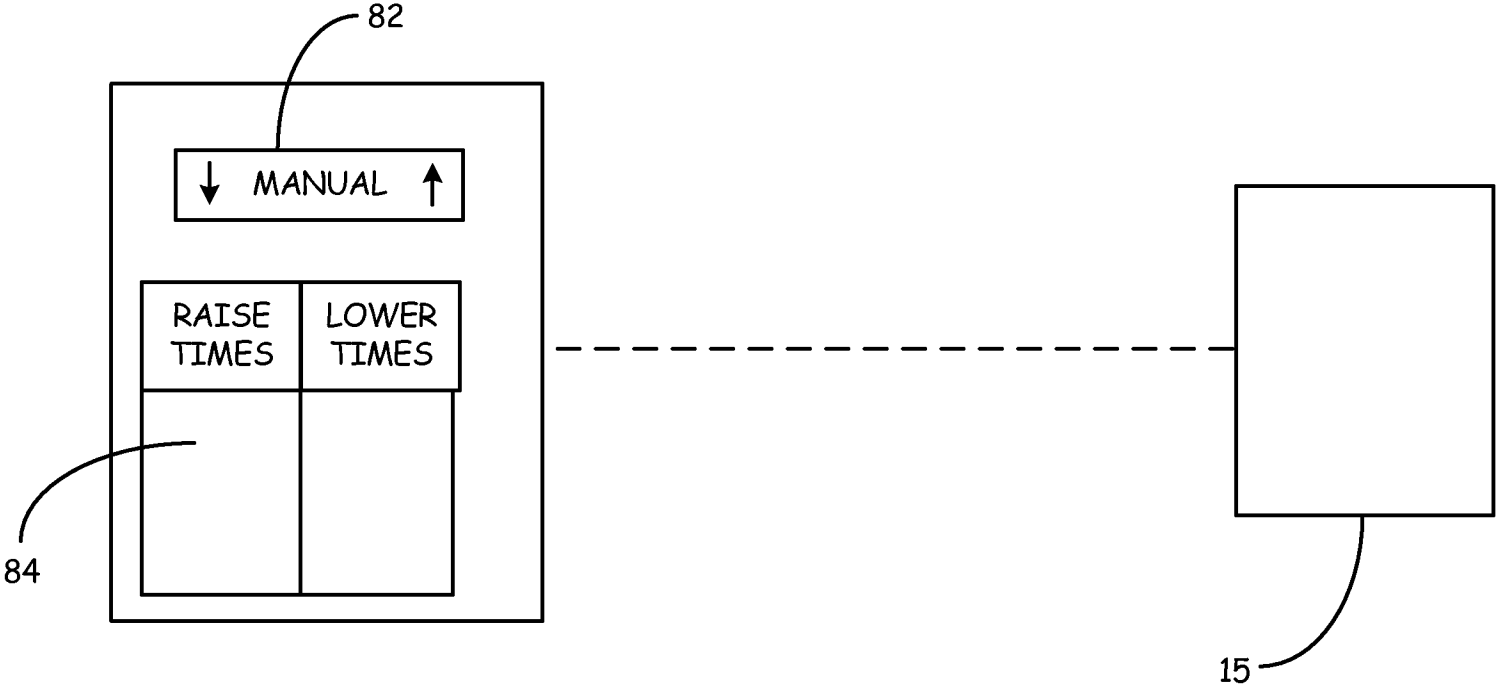
FIG. 11 is a schematic view of a control system for the rink divider raising and lowering system.

Referring to FIG. 11 it is also contemplated that the hoisting system be controlled through a control system 80 in communication with the hoisting mechanism 15. The control system 80 has a controller 82 that allows the hoisting system to be raised and lowered by the operator at the operator's discretion in a manual mode. The control system 80 also includes an automatic timing mode 84 that allows the divider wall 20 to be raised and elevated at routine times such that the ice rink can be resurfaced using a machine such as a Zamboni machine at desired times. Because the divider wall 10 can be automatically raised at desired times, the ice rink can be more efficiently used due to lower down time for resurfacing and maintenance. The automatic timing mode can also be used to automatically lower the divider wall once the ice sheet has been resurfaced.

It is also contemplated to secure a non-stick sheet or treatment on the bottom surface of the divider wall such that the divider wall 10 can be repositioned on the ice prior to the ice rink 13 fully re-freezing after being resurfaced. Contemplated materials for the non-stick sheet or treatment include, but not limited to, a rubberized sheet and/or a polytetrafluoroethylene type sheet or treatment. As such the ice rink 13 again can be utilized more efficiently and for more time throughout a particular day.

It is contemplated that the divider wall 10 may be retained utilizing pegs that can be inserted into and are retained within the foundation of the ice rink similar to that of pegs of a goal posts and that the wall 10 has tubes or through bores that are positioned over the pegs. While not illustrated, it is known that the pegs can be easily threaded through bore in the foundation of the hockey rink and then removed prior to being resurfaced similar to that of a goal post peg for a hockey rink.

Because of the permanent type and nonmoving configuration of the ice rink divider wall 10 also it is contemplated that a minimal amount of maintenance will be required, and therefore it is contemplated that only an annual inspection will be needed. As such the maintenance of the disclosed hockey rink divider wall 10 is substantially less than that of a nonpermanent and more compartmentalized type of construction.

Although the present invention has been described with reference to preferred embodiments, workers skilled in the art will recognize that changes may be made in form and detail without departing from the spirit and scope of the invention.

The invention claimed is:

1. A system for raising and lowering a rink divider within an ice rink having an ice sheet wherein a roof of the ice rink is supported by a plurality of trusses, the system comprising:

a divider wall having length configured to span from one side of the rink to an opposing side of the rink, the divider wall comprising;

a trussed frame having a bottom surface, a top surface and first and second side surfaces;

a first wall attached to the first side surface; and a second wall attached to the second side surface;

a plurality of cables having a first end attached to the divider wall at space apart intervals and having a second end;

a plurality of pulleys supported by the trusses supporting the roof wherein the plurality of cables engage the plurality of pulleys; and a hoisting mechanism configured to engage the second ends of the plurality of cables, wherein the hoisting mechanism is manipulated to raise the divider wall to a first position elevated above the ice sheet and the hoisting mechanism is manipulated to lower the divider wall to a second position wherein the divider wall engages the ice sheet.

2. The system of claim 1 and further comprising a plurality of support members attached to the plurality of trusses and wherein the plurality of pulleys are attached to the plurality of support members.

3. The system of claim 1 and further comprising a plurality of see through panels supported by the divider wall.

4. The system of claim 3 and further comprising a safety net having a bottom edge and a top edge, the bottom edge of the safety net secured proximate a top edge of the plurality of see through panels and the top edge of the safety net secured proximate the plurality of pulleys.

5. The system of claim 4 and wherein the plurality of cables are woven through the safety net such that as the divider wall is raised from the second position to the first position, the safety net folds to a compact configuration and when the divider wall is lowered form the first position to the second position the safety net unfolds and elongates.

6. The system of claim 1 and further comprising a safety net having a bottom edge and a top edge, the bottom edge of the safety net secured proximate a top edge of the divider wall and the top edge of the safety net secured proximate the plurality of pulleys.

7. The system of claim 6 and wherein the plurality of cables are woven through the safety net such that as the divider wall is raised from the second position to the first position, the safety net folds to a compact configuration and when the divider wall is lowered form the first position to the second position the safety net unfolds and elongates.

8. The system of claim 1 and where the trussed frame comprises:

a bottom substantially horizontal member;

a top substantially horizontal member;

a plurality of vertical members secured to the bottom member and the top member; and a plurality of angled trusses secured with a space defined by the bottom member, the top member and two adjacent vertical members, wherein the plurality of angled trusses are mirror images of each other.

9. The system of claim 1 and wherein the divider wall comprises a plurality of doors.

10. The system of claim 1 and further comprising a plurality of corner panels attached to opposing ends of the divider wall.

11. The system of claim 10 wherein each of the plurality of corner panels comprise:

a first section; and a second section where the first and second sections are pivotally attached together;

a first actuator configured to move the first section; and a second actuator configured to move the second section such that a curvature of the corner panels is adjustable.

12. The system of claim 1 and wherein the divider wall comprises a plurality of doors.

13. The system of claim 1 and wherein the trussed frame, the first wall and the second wall are constructed of high density polyethylene.

14. The system of claim 1 and further comprising a safety net having a bottom edge and a top edge, the bottom edge of the safety net secured proximate the top surface of the trussed frame.

15. A system for raising and lowering a rink divider within an ice rink having an ice sheet wherein a roof of the ice rink is supported by a plurality of trusses, the system comprising:

a divider wall having length configured to span from one side of the rink to an opposing side of the rink, the divider wall comprising;

a trussed frame having a bottom surface, a top surface and first and second side surfaces;

a first wall attached to the first side surface, and a second wall attached to the second side surface;

a plurality of cables having a first end attached the divider wall at space apart intervals and having a second end;

a plurality of pulleys supported by the trusses supporting the roof wherein the plurality of cables engage the plurality of pulleys;

a hoisting mechanism configured to engage the second ends of the plurality of cables, wherein the hoisting mechanism is manipulated to raise the divider wall to a first position elevated above the ice sheet and the hoisting mechanism is manipulated to lower the divider wall to a second position wherein the divider wall engages the ice sheet; and a control system in communication with the hoisting mechanism—wherein the control system is utilized to manipulate the hoisting mechanism to move the divider wall from the first position to the second position and back.

16. The system of claim 15 and wherein the control system is configured to be operated in a manual mode or in an automatic mode configured to raise and lower the divider wall at selected times.

* * * * *